US006305134B1

(12) United States Patent
Robinson

(10) Patent No.: US 6,305,134 B1
(45) Date of Patent: Oct. 23, 2001

(54) SUSPENDED BRICK WALL SYSTEM

(75) Inventor: John Crawford Robinson, Raymond Terrace (AU)

(73) Assignee: Industrial Galvanizers Corporation Pty Ltd, Hexham (AU)

( * ) Notice: Subject to any disclaimer, the term of this patent is extended or adjusted under 35 U.S.C. 154(b) by 0 days.

(21) Appl. No.: 09/267,880

(22) Filed: Mar. 11, 1999

(51) Int. Cl.[7] ..... E02D 27/42

(52) U.S. Cl. ..... 52/299; 52/292; 52/126.1; 248/357

(58) Field of Search ..... 52/126.6, 126.5, 52/126.1, 122.1, 169.9, DIG. 3, 299, 300, 292, 579, 726.2, 726.3, DIG. 11; 248/122, 124.1, 225.11, 227.3, 346.5, 357

(56) References Cited

U.S. PATENT DOCUMENTS 4,635,413 * 1/1987 Hansen ..... 52/92
4,937,989 * 7/1990 Miyares ..... 52/126.7
5,402,614 * 4/1995 Jewell ..... 52/299
5,509,237 * 4/1996 Coulter ..... 52/126.6
5,690,305 * 11/1997 Perkins ..... 52/169.12
5,850,718 * 12/1998 MacKarvich ..... 52/292
5,946,867 * 9/1999 Snider ..... 52/167.1

FOREIGN PATENT DOCUMENTS

AU-B-34028 4/1985 (AU) .
AU-A-45537 7/1985 (AU) .
AU-B-23609 9/1989 (AU) .
AU-A-52635 7/1994 (AU) .

* cited by examiner

*Primary Examiner*—Beth A. Stephan
(74) *Attorney, Agent, or Firm*—David P Gordon; David S Jacobson; Thomas A Gallagher

(57) ABSTRACT

A support structure for a building comprises a pair of steel piers (11) embedded into or supported upon a ground surface so as to extend upwardly therefrom. The structure also comprises a wall support lintel (80,90) secured to each pier (11) so as to extend substantially horizontally therebetween. The structure also comprises a respective floor support member (50) secured to each pier.

12 Claims, 13 Drawing Sheets

SUSPENDED BRICK WALL SYSTEM

BACKGROUND OF THE INVENTION

1. Field of the Invention

The following invention relates to a suspended brick wall lintel system. More particularly, though not exclusively, the invention relates to a system used to support brick veneer walls off the ground in the construction of brick veneer dwellings without the requirement for conventional concrete foundations, footings or a concrete slab poured directly onto the ground.

2. State of the Art

Known method of constructing full brick and brick veneer dwellings require the wall systems to come into intimate contact with the ground. Thus white ant and drainage problems prevail.

The construction of such dwellings is a time consuming process which is labour intensive and requires special tools and skills.

Also, known construction methods involve a high level of distance to the natural ground.

SUMMARY OF THE INVENTION

It is the object of the present invention to overcome or substantially ameliorate the above disadvantages and/or more generally to provide an improved building system.

There is disclosed herein a support structure for a building, comprising:

- a pair of steel piers embedded into or supported upon a ground surface so as to extend upwardly therefrom,
- a wall support lintel secured to each pier so as to extend substantially horizontally therebetween, and
- a respective floor support member secured to each pier.

Preferably the wall support lintel is secured to each pier by means of a lintel support bracket which is vertically, adjustably affixed to each pier.

Preferably the floor support comprises a bracket which is vertically, adjustably affixed to the pier above the wall lintel support bracket.

Preferably the piers are either the screw, driven or concrete footing supported type.

The piers can have a circular or square cross section or cross section of any shape.

Preferably the lintel support bracket comprises a ledge upon which the wall support lintel rests.

Preferably the lintel support bracket comprises a latching bar and each wall support lintel comprises a lip engageable with the bar so as to laterly restrain the wall support lintel.

Preferably the lintel support bracket and floor support bracket comprise hollow members adapted to surround the pier.

Preferably the lintel support bracket and floor support bracket comprise laterally projecting tapped apertures through which a fastener extends, the threaded fastener, upon rotation thereof, being adapted to bear against the pier so as to secure the respective bracket thereto. Typically in this operation, the pier is deformed by the threaded fastener.

There is further disclosed herein a wall lintel support bracket comprising a hollow member adapted to surround a pier, the bracket further comprising a ledge adapted to support a wall lintel and a latching bar adapted to engage with the wall lintels so as to restrain lateral movement thereof.

In a preferred embodiment, each lintel support bracket has associated therewith an adjustment plate adapted to secure the wall support lintel to the support bracket.

Preferably, the adjustment plate comprises a slot through which a threaded fastener passing through the lintel support bracket can pass so as to allow positional adjustment of the adjustment plate with respect to the lintel support bracket.

Preferably, the slot extends in a direction substantially perpendicular to the longitudinal extent of the wall support lintel.

Preferably, the lintel support bracket is affixed to the respective steel pier by means of U-bolts or the like.

Preferably, a shear stud extends from the lintel support bracket through a hole in the steel pier.

There is further disclosed herein a support structure for a building comprising:

- a pair of steel piers embedded into or supported upon a ground surface so as to extend upwardly therefrom,
- a wall support lintel secured to each pier so as to extend substantially horizontally therebetween, the wall support lintel including a ledge upon which a wall is supported, the ledge being positioned upon each pier so as to bear downwardly thereon directly from above.

Preferably an adjustable cap bracket is affixed to an upper end portion of each pier, the adjustable cap bracket supporting said wall support lintel.

Preferably, the adjustable cap bracket is designed to enable height adjustment of the wall support lintel.

Preferably, the adjustable cap bracket is secured to the wall support lintel by means of a retaining bracket or brackets.

The above form of the invention in which the wall support lintel is positioned directly upon each pier is particularly suitable for application is existing dwellings about which a new brick veneer wall is to be installed. That is, each pier does not require a floor support member as the floor is already supported by existing structural elements. As an advantage of bearing the load of the wall directly upon an upper end of each pier, no shear forces need be withstood by the adjustable cap bracket. That is, the adjustable cap bracket can bear directly down upon an upper end of the pier and this increases the load carrying capacity of the braket. As a result, the disclosed structure can support the weight of two storys of bricks, rather than a single story of bricks, the load of which might be sustained by the support store described earlier.

There is further disclosed herein a method of supporting a building, the method comprising:

- embedding or otherwise supporting into or upon a ground surface a pair of steel piers so as to extend upwardly therefrom,
- securing a wall support lintel to each pier so as to extend substantially horizontally therebetween, and
- securing a floor support member to each pier so as to support a floor.

There is still further disclosed herein a method of supporting a wall about an existing building framework, the method comprising:

- embedding into or supporting upon a ground surface a pair of steel piers so as to extend upwardly therefrom,
- positioning a wall support lintel upon each pier so as to extend substantially horizontally therebetween, the wall support lintel including a ledge, the ledge being positioned upon each pier so as to bear downwardly thereon directly from above, and
- erecting a wall upon said ledge.

BRIEF DESCRIPTION OF THE DRAWINGS

A preferred form of the present invention will now be described by way of example with reference to the accompanying drawings, wherein.

DESCRIPTION OF THE PREFERRED EMBODIMENT

Figure 1:
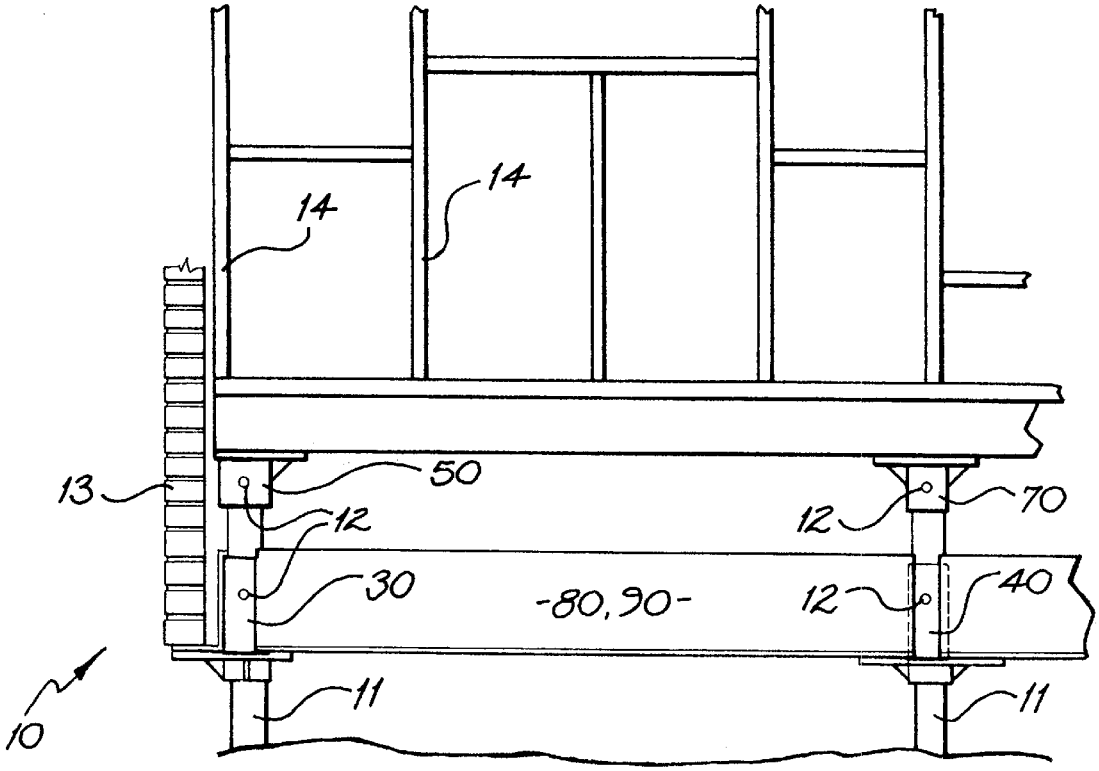
FIG. 1 is a schematic elevational view of a brick veneer dwelling.

In FIG. 1 of the accompanying drawings there is schematically depicted a brick veneer dwelling supported by a support structure 10. Support structure 10 comprises a plurality of piers 11 which are typically, though not exclusively hollow circular galvanised steel piers of either the screw, driven or concrete footing support type. However, it should be appreciated that square cross sections or cross sections of any other shape can be used. For example, the piers 11 could be of the form of an H lintel.

Figure 3A:
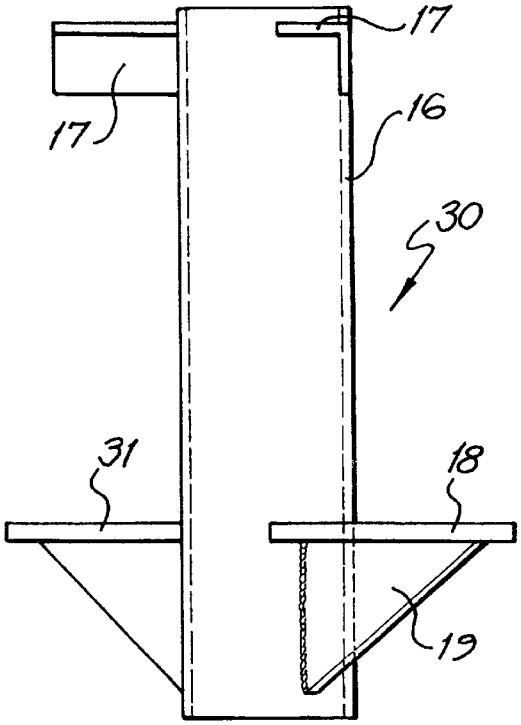
FIG. 3A is a schematic elevational view of an outside corner support bracket.
Figure 3B:
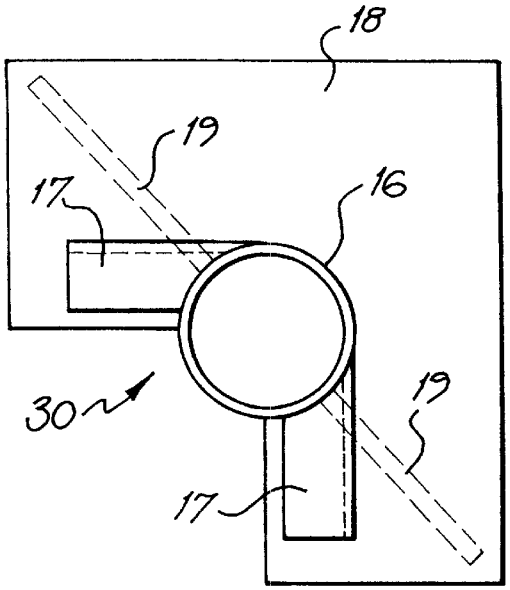
FIG. 3B is a schematic plan view of the bracket of FIG. 3A.
Figure 4A:
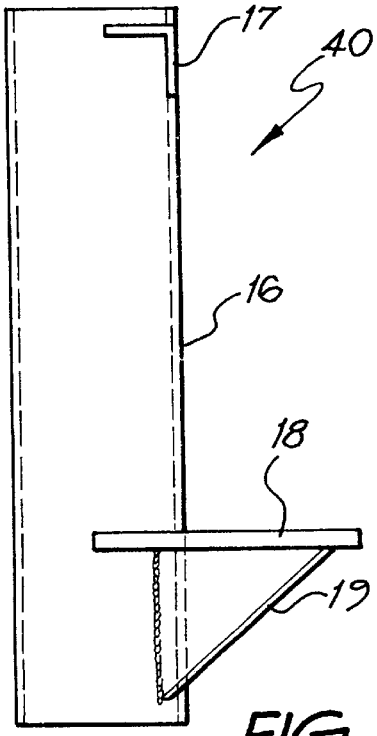
FIG. 4A is a schematic elevational view of a trough-bracket.
Figure 4B:
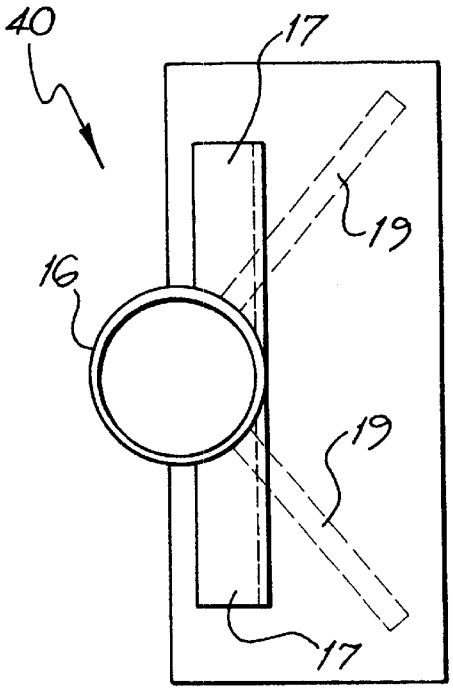
FIG. 4B is a schematic plan view of the bracket of FIG. 4A.
Figure 8:
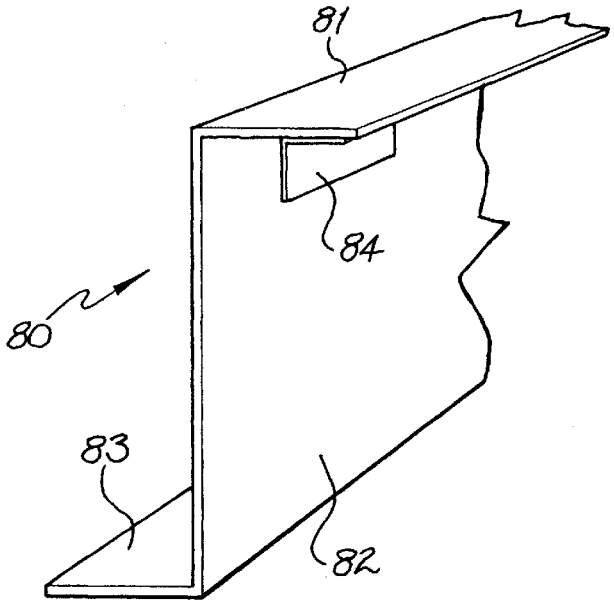
FIG. 8 is a schematic perspective view of a wall support lintel.
Figure 9:
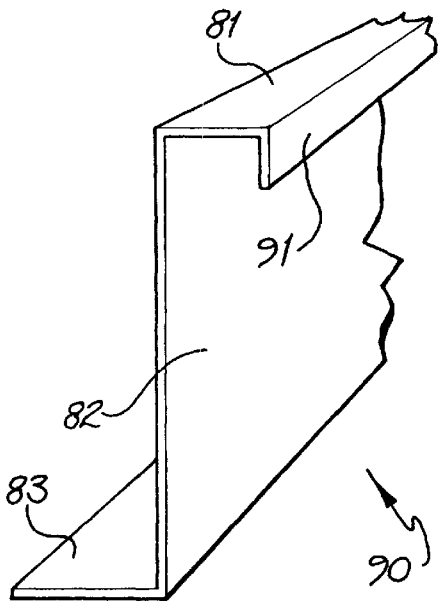
FIG. 9 is a schematic perspective view of another wall support lintel.

Secured to each pier 11 is one of a variety of wall line support brackets. Typically, these brackets are those embodied as 20, 30 and 40 in FIGS. 2 to 4. Supported by the respective brackets 20, 30, 40 and so as to span between respective piers 11 are wall support lintels 80 or 90. These lintels as illustrated in FIGS. 8 and 9 can have a maximum lenght which depend on loadings and floor dimensions. Typically, the span of each lintel might be about 3.6 meters.

Situated above each wall lintel support bracket 20, 30, 40, is one of a variety of cap brackets. Typically, though not exclusively, these cap brackets are embodied as 50, 60 and 70 in FIGS. 5 to 7.

Whereas the wall lintel 80 or 90 is adapted to support a brick vent wall 13, the cap brackets are adopted to support a floor and internal wall frame structure 14.

Figure 2A:
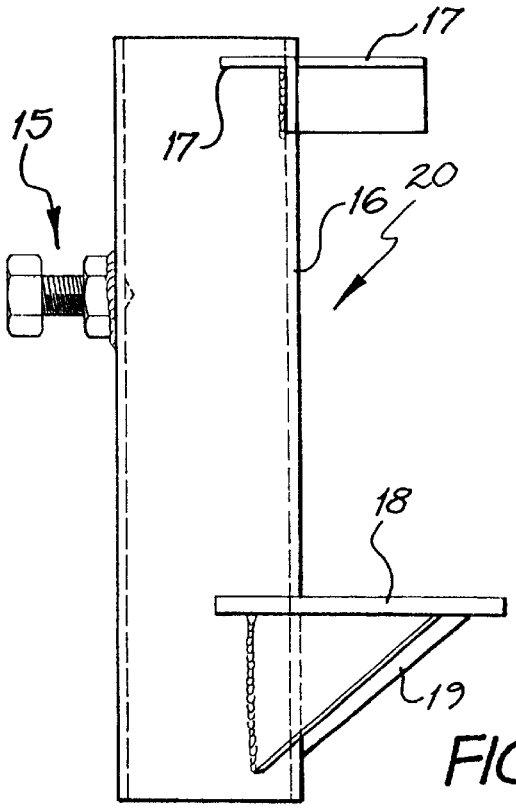
FIG. 2A is a schematic elevational view of an internal corner support bracket.
Figure 2B:
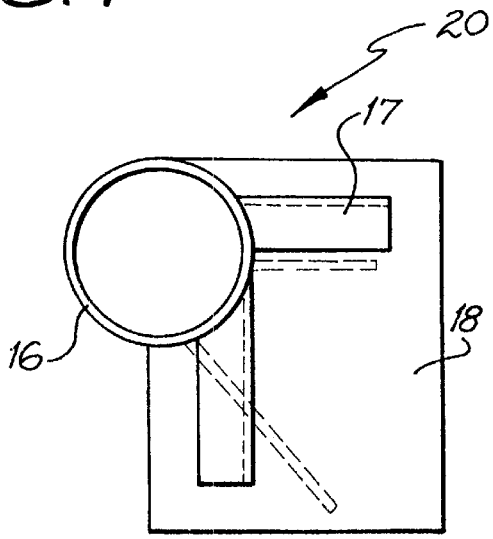
FIG. 2B is a schematic plan view of the bracket of FIG. 2A.

With reference to FIGS. 2A and 2B, a wall lintel internal corner bracket 20 is depicted. Bracket 20 comprises a hollow tubular member 16 adapted to surround the pier 11. Welded or otherwise attached to hollow tubular member 16 is a ledge 18. For rigidly securing the ledge 18 to the member 16, one or more webs 19 can be provided. These webs are typically welded to the member 16 and ledge 18.

Positioned above the ledge 18 and secured to the hollow member 16 by similar means is a latching bar or bars 17.

Welded to the hollow member 16 is a nut and bolt combination 15. A aperture extends through the wall of hollow member 16 such that the bolt can pass therethrough. Upon turning of the bolt, the end thereof bears against the external surface of the pier 11. Upon further tightening of the bolt, the pier 11 is deformed to prevent vertical movement of the wall lintel support bracket thereon.

The wall lintel bracket depicted in FIGS. 2A and 2B is adapted to support respective ends of a pair of lintels meeting at an internal corner of a structure.

The brackets 30 and 40 are similar to bracket 20. Bracket 30 is adapted to support the ends of a pair of wall lintels meeting at an outside corner of a structure. Although not depicted, a nut and bolt combination 15 is also to be provided for brackets 30 and 40.

Bracket 40 is a wall lintel through-bracket adapted to support the ends of a pair of co-linear end-to-end wall lintels at a position along a wall of a structure. In each of the embodiments, a pair of latching bars 17 is provided.

Referring now to FIGS. 8 and 9, two alternative wall lintels 80 and 90 are shown. Each wall lintel comprises 4 horizontal segment 83 each end of which is adapted to sit upon ledge 18 of one of the respective support brackets 20, 30 or 40. Each lintel also comprises a central web 82 connecting the lower horizontal portion 83 with an upper horizontal portion 81.

In the embodiment of FIG. 8, a lip 84, formed from a length of angle iron, is welded to the underside of the upper horizontal portion 81. Lip 84 is adapted to cooperate with latching bar 17 so as to laterally restrain the wall lintel with respect to the pier 11.

In the embodiment of FIG. 9, the lip 91 is integrally formed with the lintel as depicted.

Figure 5A:
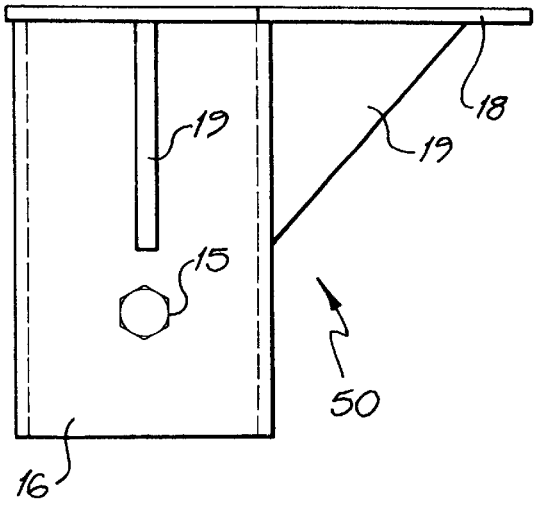
FIG. 5A is a schematic elevational view of an outside corner cap bracket.
Figure 5B:
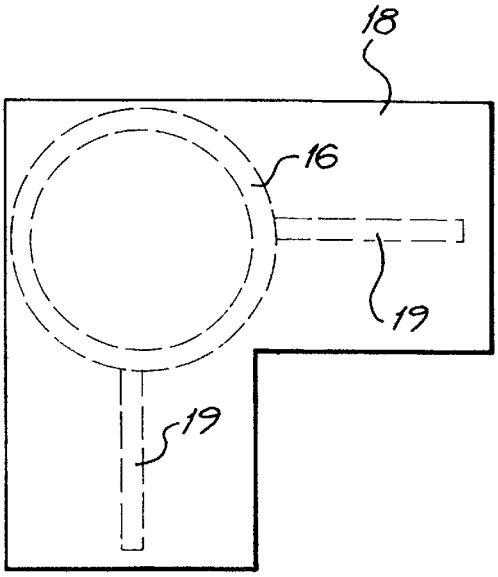
FIG. 5B is a schematic plan view of the bracket of FIG. 5A.

In FIGS. 5A to 7B a number of alternative cap brackets are depicted. In FIGS. 5A and 5B an outside corner cap bracket 50 is depicted. The cap bracket 50 comprises a ledge 18, this time adapted to support a floor support lintel. The ledge 18 can be strengthened by means of webbing 19 as depicted. The ledge 18 extends in two directions radially of the hollow member 16 as shown. A nut and bolt combination 15 is provided in the hollow member 16 and serves to secure the member 16 to the pier 11 in a manner similar to that of the nut and bolt combination 15 described above in reference to FIG. 2A.

Figure 6A:
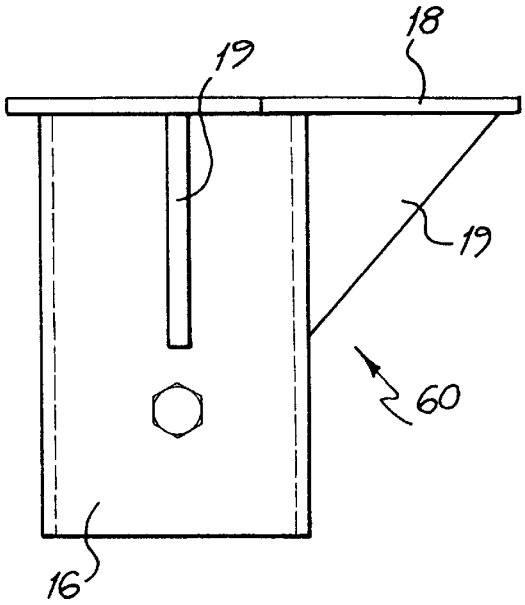
FIG. 6A is a schematic elevational view of an inside corner cap bracket.
Figure 6B:
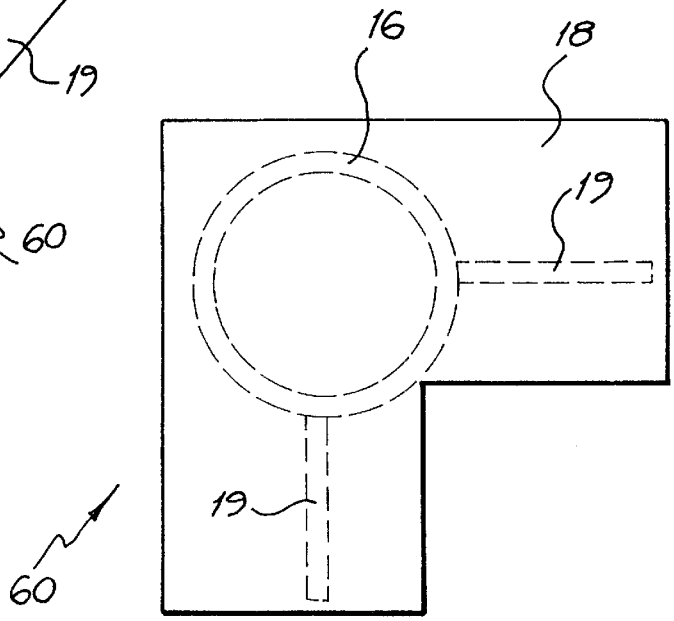
FIG. 6B is a schematic plan view of the bracket of FIG. 6A.

FIGS. 6A and 6B illustrate a further cap bracket 60, this time adapted for use at an inside corner of a dwelling. This bracket is substantially identical to that of FIGS. 5A and 5B however the shape of the ledge 18 differs slightly as shown.

Figure 7A:
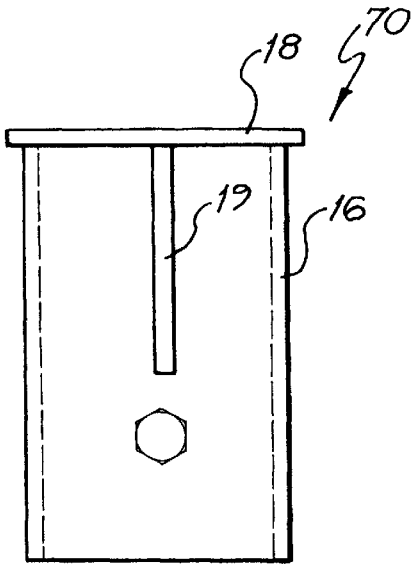
FIG. 7A is a schematic elevational view of a trough cap bracket.
Figure 7B:
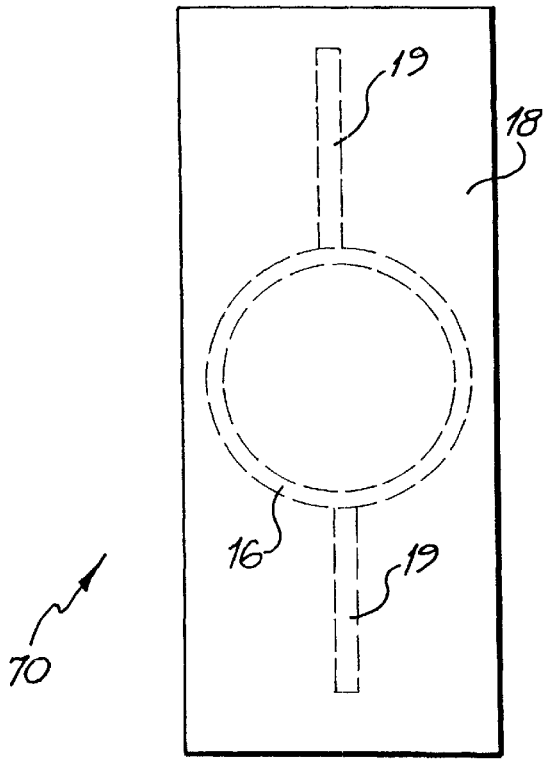
FIG. 7B is a schematic plan view of the bracket of FIG. 7A.

A through cap bracket 70 depicted in FIGS. 7A and 7B is similarly constructed though comprises a ledge 18 extending from diametrically opposed sides of the hollow member 16. The through cap bracket is adapted to support a floor structure, at a location somewhere along a straight wall.

Advantages of the above described invention are in efficient brick load carrying performance, easy level adjustment on site by means of the nut and bolt combinations 15, the easy attachment of the lintels 80, 90 and the supporting of both the external brick veneer wall as well as the internal structure of the dwelling upon common piers.

Figure 10:
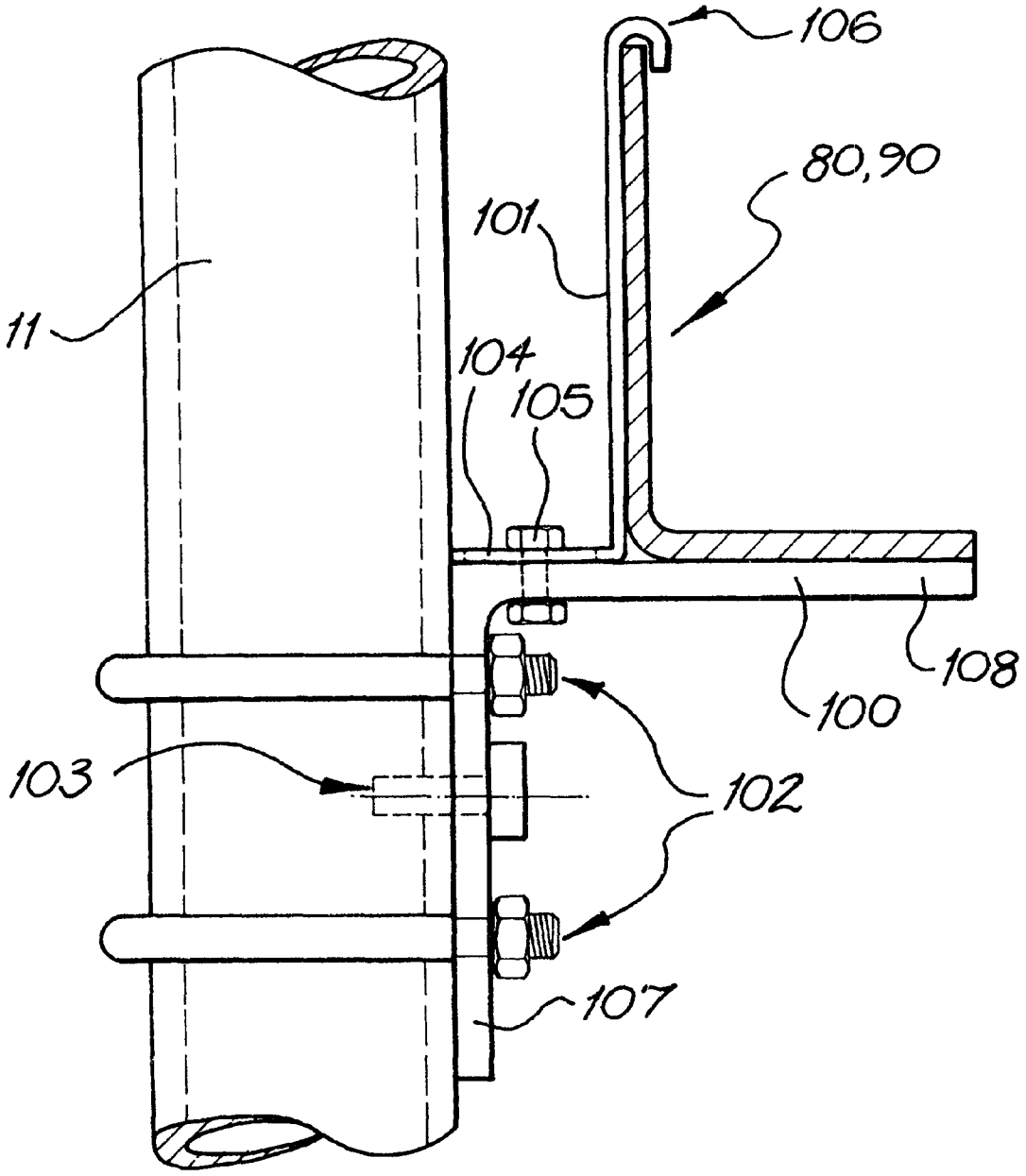
FIG. 10 is a schematic end elevational view of a wall lintel through bracket.
Figure 11:
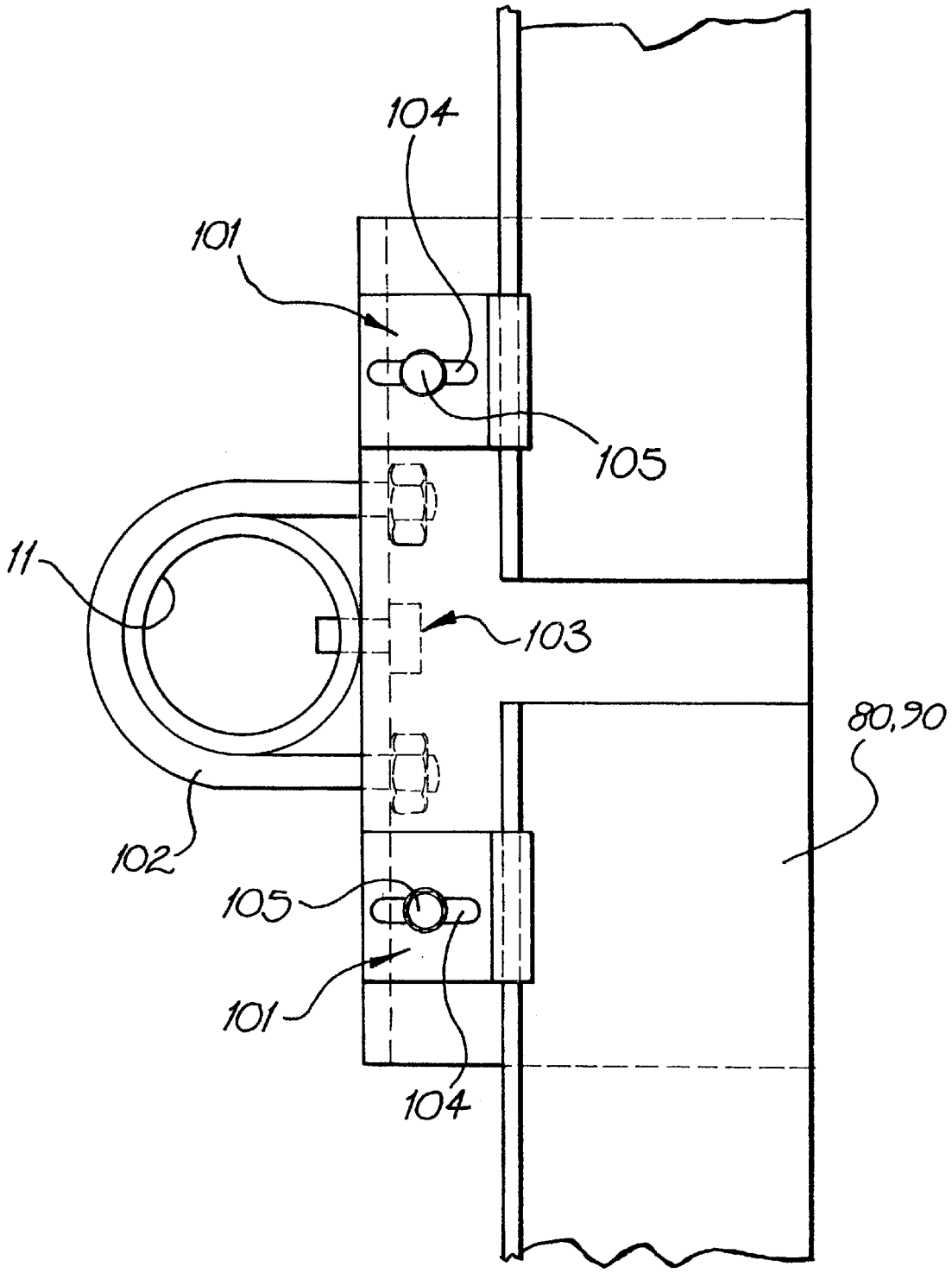
FIG. 11 is a schematic plan view of the bracket of FIG. 10.

Alternative wall lintel support brackets art shown in FIGS. 10 to 15. In FIGS. 10 and 11 there is schematically depicted a wall lintel though-bracket 100 affixed to a pier 11. Support bracket 100 comprises a vertically extending leg 107 and a horizontally extending platform 108. Leg 107 is affixed to the pier 11 by means of a pair of U-bolts 102. A shear pin or stud 103 extends through the leg 107 into a hole drilled through the sidewall of pier 11. The shear pin 103 shares part of the vertical loading held by the wall lintel through bracket 100. Passing through the horizontal platform 108 is a bolt 105. This bolt secures an adjustment plate 101 to the platform 108. The adjustment plate 101 comprises a slot 104 extending in a direction which is substantially normal to the longitudinal extent of the wall support lintel 80,90. A lip 106 is provided at the upper extremity of the adjustment plate 101 which passes over and around the upper lip of the wall support lintel 80,90.

As can be seen, both the vertical position and the horizontal position of the support bracket 100 can be adjusted by means of slot 104 and shear pin 103. That is, the vertical position of the bracket 100 can be altered by drilling more holes through the side wall of the pier 11 and refitting the shear pin 103 thereto.

Figure 12:
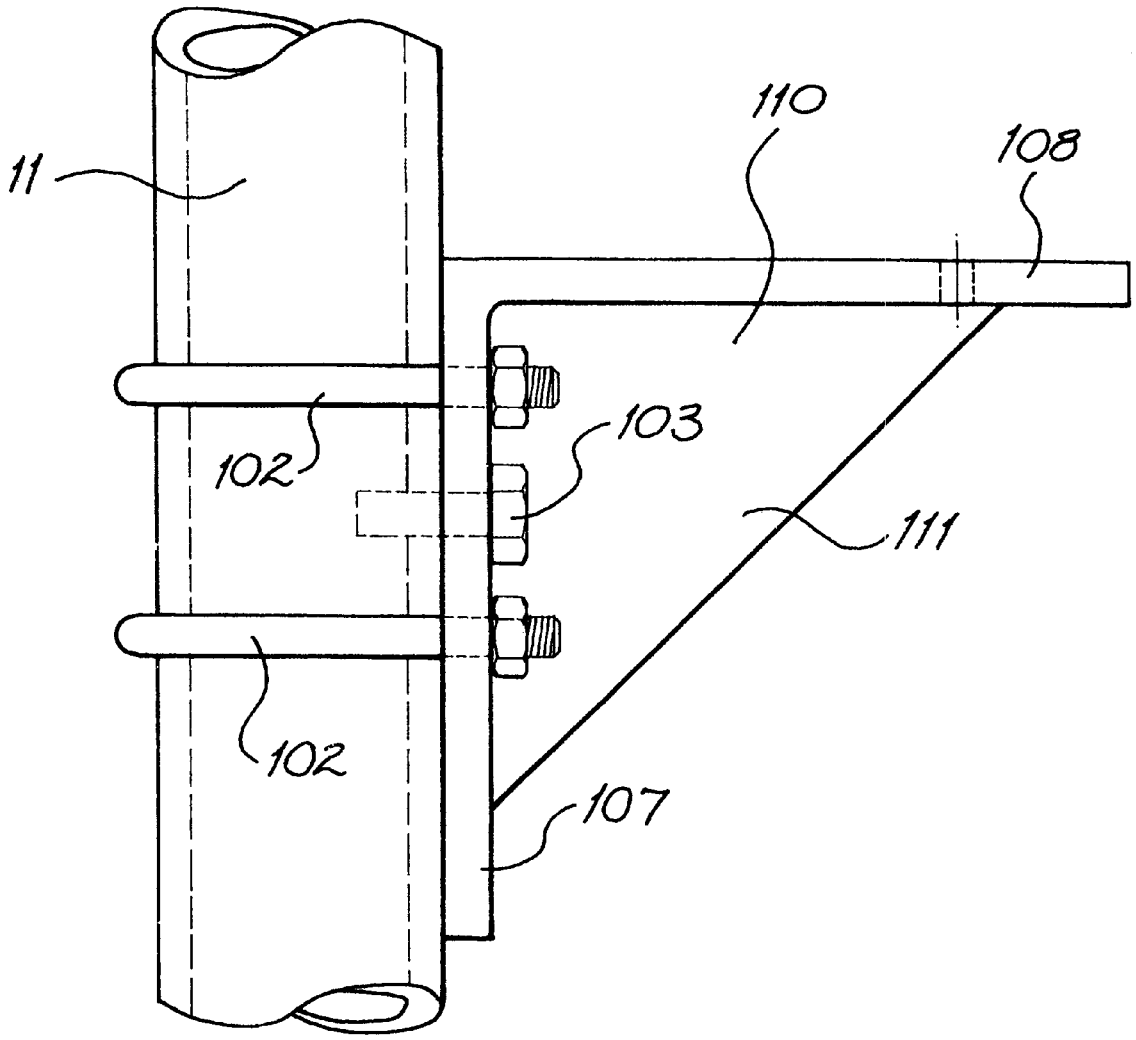
FIG. 12 is a schematic end elevational view of an internal corner bracket.
Figure 13:
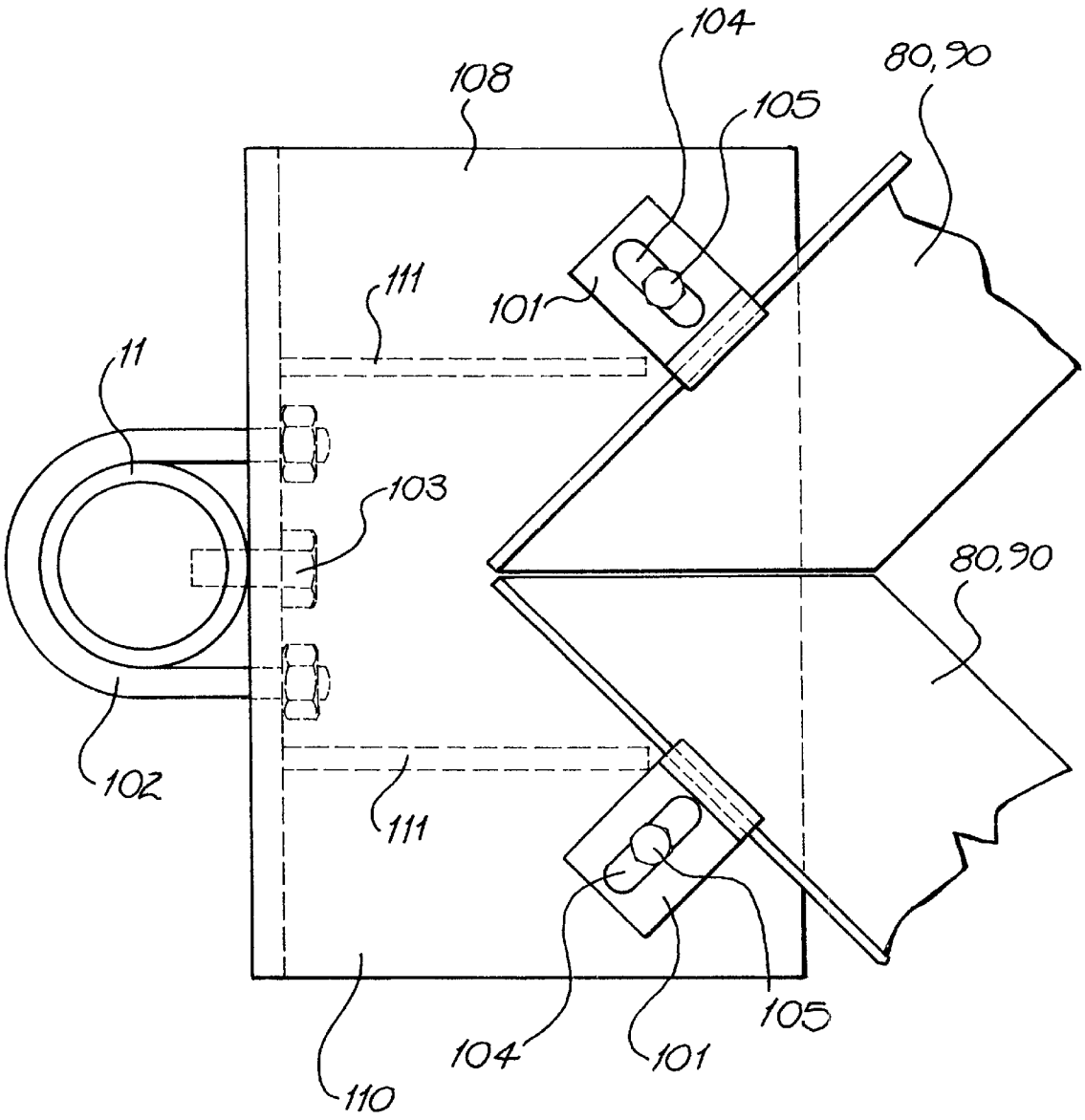
FIG. 13 is a schematic plan view of the bracket of FIG. 12.

In FIGS. 12 and 13 there is depicted a wall lintel internal corner bracket 110. Bracket 110 is secured to the pier 11 by means of U-bolts 102 and shear pin 103 as depicted. That is, the bracket 110 also comprises a vertically extending leg 107 and a platform 108. The leg 107 has attached thereto the U-bolts 102 and shear pin 103 as per the embodiment of FIGS. 10 and 11. To the horizontal platform 108 there is affixed a pair of bolts 105. Each bolt 105 is associated with an adjustment plate 101 serving the same function of the plate of corresponding number in FIGS. 10 and 11. By adjustment of the plates 101 with respect to the bolts 105, the horizontal position of the lintels 80,90 can be adjusted in a direction substantially normal to their longitudinal extent.

Figure 14:
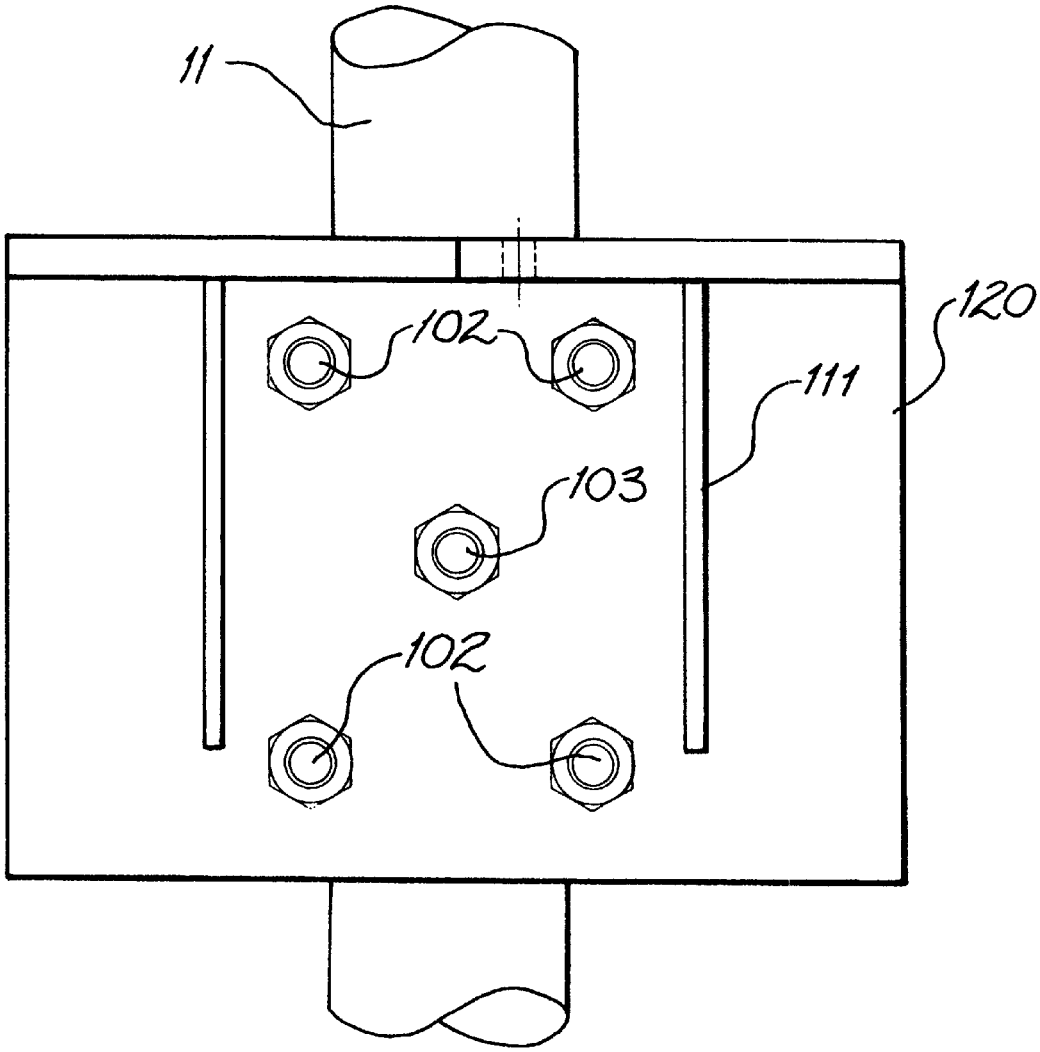
FIG. 14 is a schematic front elevational view of an external corner bracket.
Figure 15:
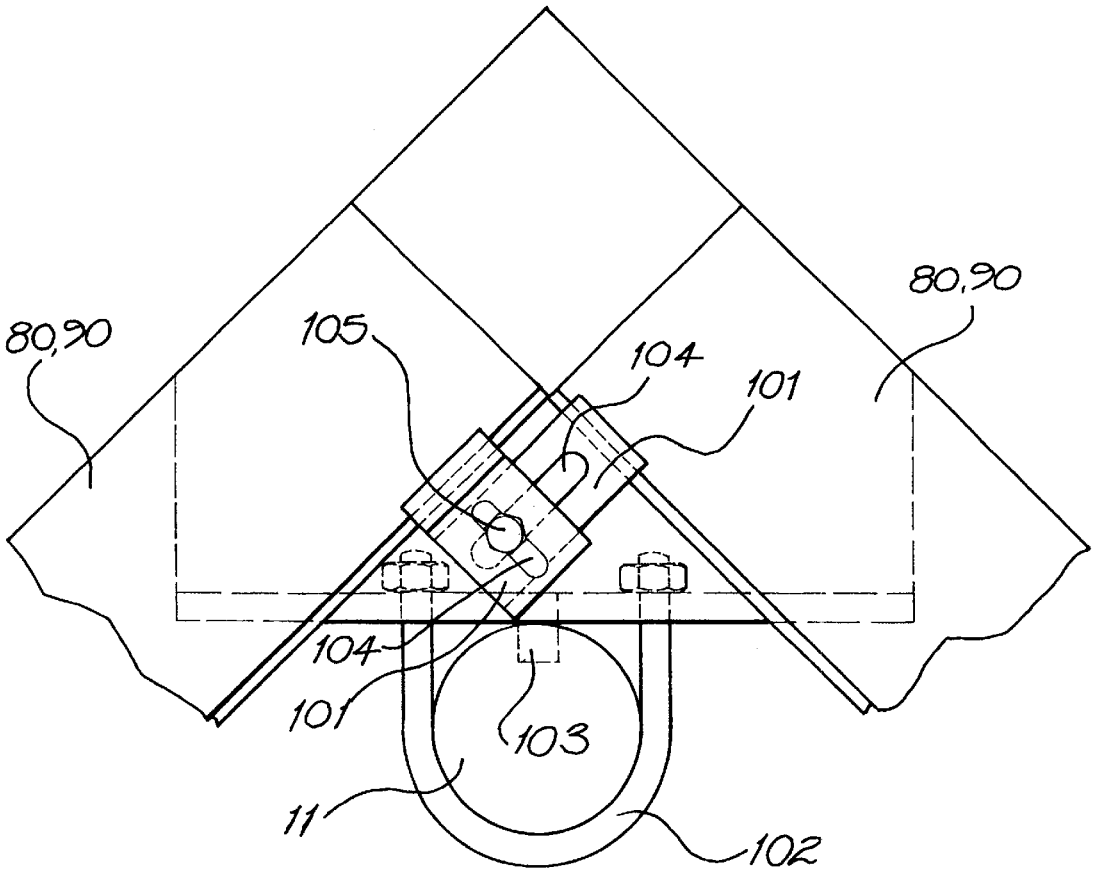
FIG. 15 is a schematic plan view of the bracket of FIG. 14.

In FIGS. 14 and 15 there is schematically depicted a wall lintel extent corner bracket 120 similar to bracket 110, though this time including only a single bolt 105 cooperating with a pair of overlapping adjustment plates 101, each having a slot 104. The single bolt 105 passes through each slot 104. The horizontal position of each lintel 80,90 can be adjusted in a direction substantially normal to the direction of their respective longitudinal extents.

The vertical position of the brackets 110 and 120 can be adjusted by vertically repositioning the U-bolts and passing the shear stud 103 through another hole in the pier 11.

Figure 16:
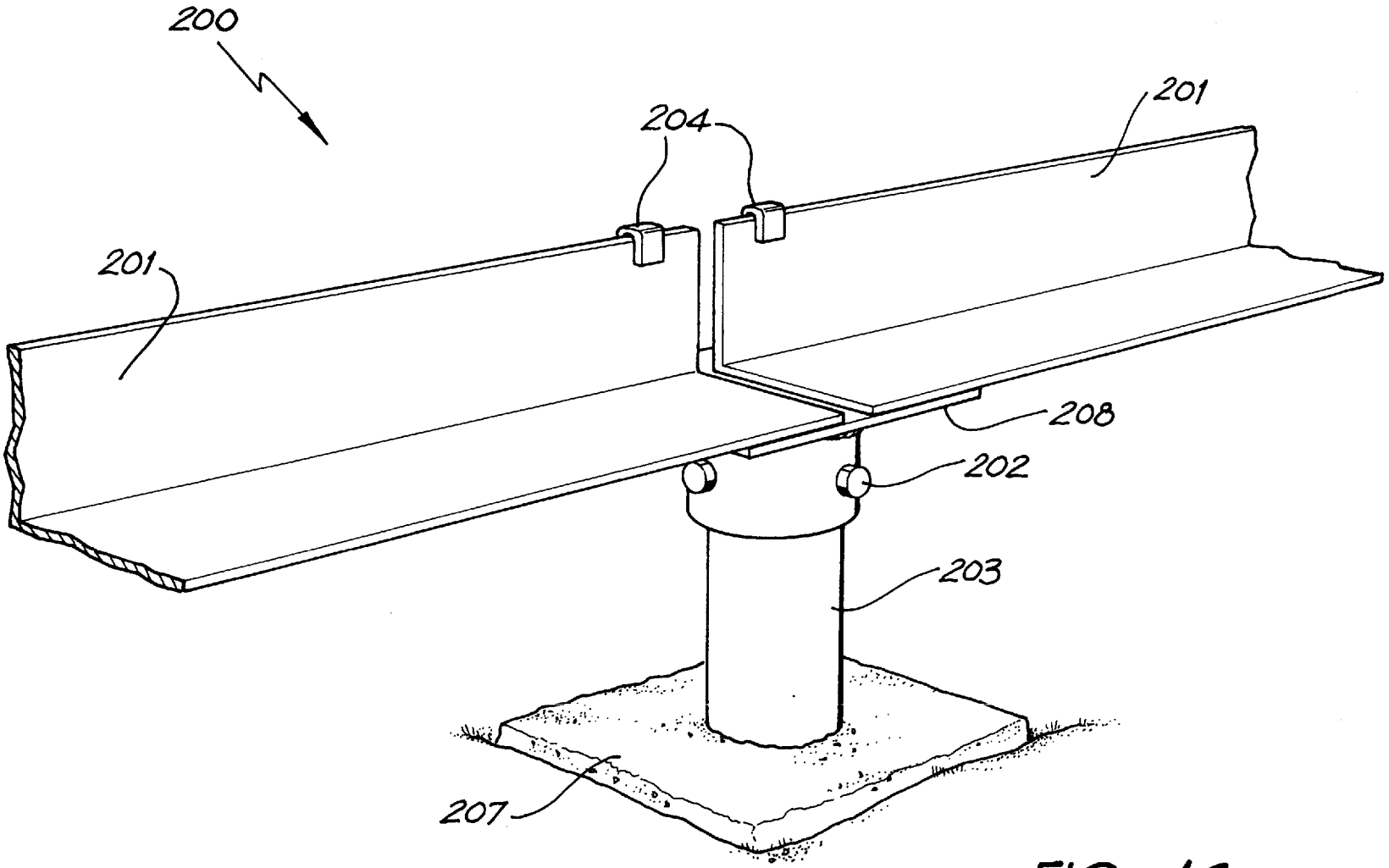
FIG. 16 is a schematic perspective view of another wall support system.
Figure 17:
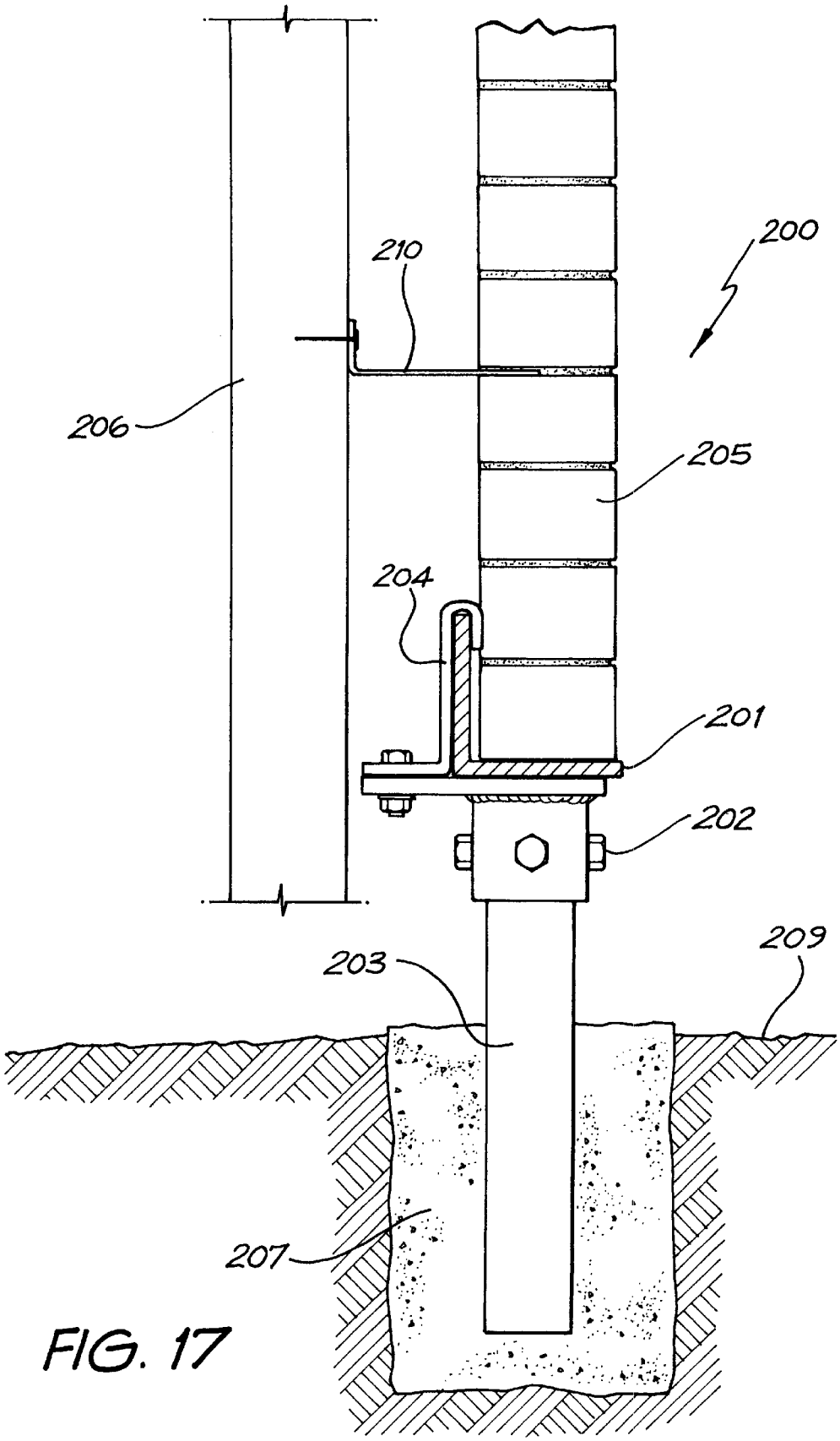
FIG. 17 is a schematic end elevational view of the system of FIG. 16 alongside an existing building framework.
Figure 18:
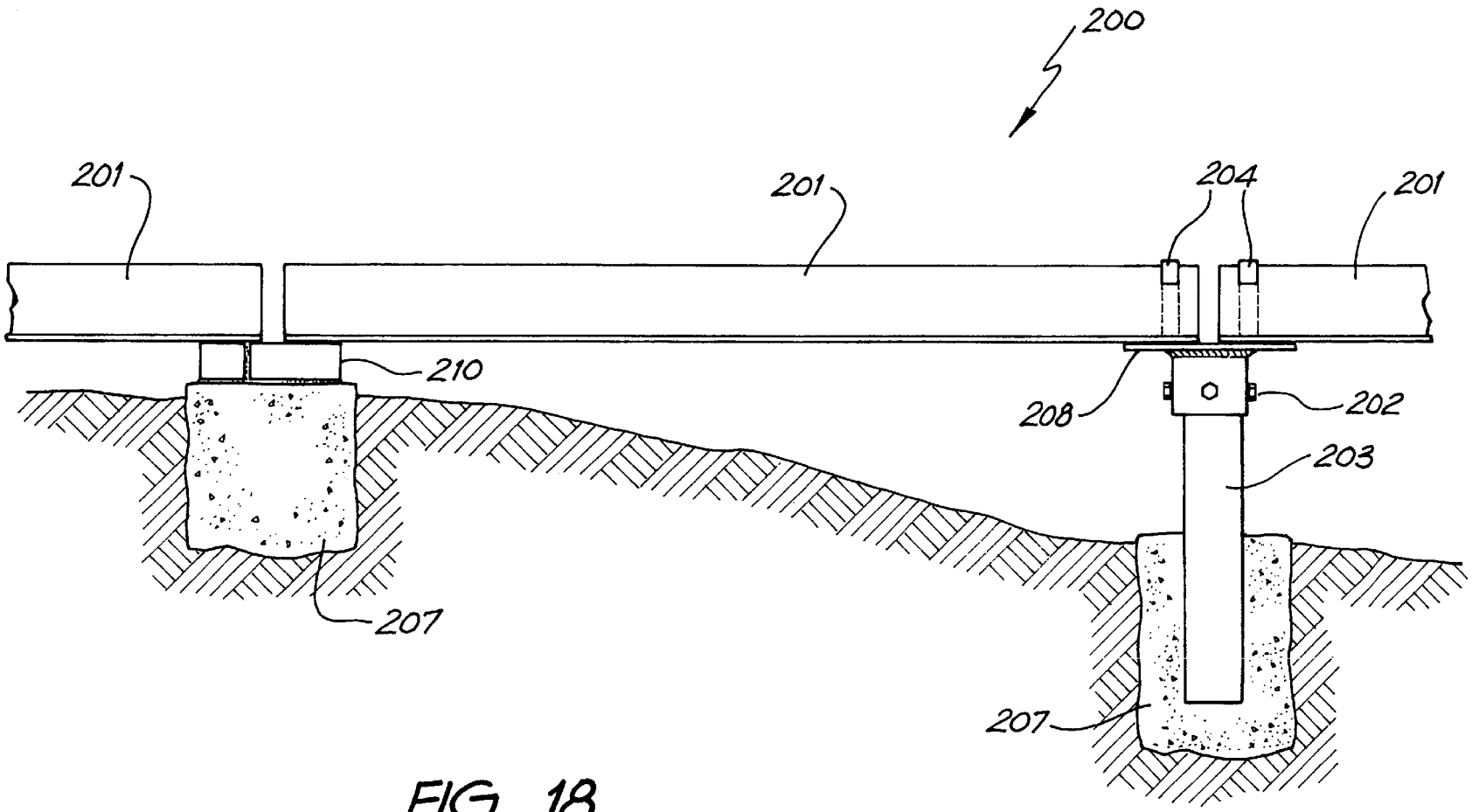
FIG. 18 is a schematic side elevational view of the system of FIGS. 16 and 17.

In FIGS. 16 to 18 of the accompanying drawings there is schematically depicted another wall lintel support system 200. This system includes a cast-in pier 203 embedded within a concrete footing 207. Alternatively, a screw-it pier can be employed. Such piers 203 are positioned around the periphery of an existing building framework 206. Where the ground surface 209 is undulating or sloped for example, a brick pier 210 might be provided upon a concrete footing 207 as depicted min FIG. 18. The wall support lintel 201 might typically be a 105×100 mm galvanized lintel.

To the upper end of each pier 203, there is affixed an adjustable cap bracket 202. The cap bracket 202 includes a support platform 208 upon which the respective ends of the wall support lintel 201 are supported.

The piers 203 might typically be formed of hollow galvanized steel pipe section and might be provided with apertures near their upper ends. Retaining bolts can pass through these apertures so as to enable securing of the adjustable cap bracket 202 thereto. A number of such apertures can be provided at varying heights in the pier 203 to enable vertical adjustment of the cap bracket as required to enable a levelling of wall support lintels 201. Retaining brackets 204 can be used to retain the wall support lintels to the adjustable cap bracket. These retaining brackets can take the form of a strap extending up and over the upper lip nearby the end portion of each wall support lintel 201. As shown best in FIG. 17, the wall support system 200 is to be positioned alongside the framework 206 of an existing building. A veneer wall of bricks 205 is shown supported upon the wall support lintel 201. A number of brick ties 201 can be used to retain the brick veneer wall 205 with respect to the existing frame 206.

As can be seen in FIG. 17, the wall support lintels 201 bear directly down upon the pier 203 into the concrete footings 207. This arrangement compares favourably with that depicted in FIG. 1 for example, wherein the brick veneer wall is laterally offset from the pier. The arrangement depicted in FIG. 17 is suited to supporting two storeys of bricks in the construction of a two storey house for example.

It should be appreciated that modifications and alterations obvious to those skilled in the art are not to be considered as beyond the scope of the present invention. For example, the wall lintel support brackets could be formed integrally with or be welded or otherwise affixed to the wall lintels.

What is claimed is:

1. A support structure for a building, comprising: a pair of steel piers embedded into or supported upon a ground surface so as to extend upwardly therefrom, a wall support beam secured to each pier so as to extend substantially horizontally therebetween wherein the wall support beam is secured at respective ends thereof to each pier by means of a respective beam support bracket, each of which is vertically, adjustably affixed to a respective one of said piers, and a respective floor support member secured to each said pier.

2. The support structure of claim 1, wherein each floor support member comprises a bracket which is vertically, adjustably affixed to a respective one of said piers above the wall beam support bracket.

3. The support structure of claim 1, wherein each beam support bracket comprises a ledge or platform upon which the wall support beam rests.

4. The support structure of claim 1, wherein each beam support bracket comprises a latching bar and each wall support beam comprises a lip engageable with the bar so as to laterally restrain the wall support beam.

5. The support structure of claim 2, wherein each beam support bracket and each floor support bracket comprise a hollow member adapted to surround the pier.

6. The support structure of claim 2, wherein each beam support bracket and each floor support bracket comprise laterally projecting tapped apertures through which a threaded fastener extends, the threaded fastener, upon rotation thereof, being adapted to bear against a respective one of said piers so as to secure the respective bracket thereto.

7. The support structure of claim 1, wherein each beam support bracket has associated therewith an adjustment plate adapted to secure the support beam to the support bracket.

8. The support structure of claim 7, wherein the adjustment plate comprises a slot through which a threaded fastener passing through the beam support bracket can pass so as to allow positional adjustment of the adjustment plate with respect to the beam support bracket.

9. The support structure of claim 8, wherein the slot extends in a direction substantially perpendicular to the longitudinal extent of the wall support beam.

10. The support structure of claim 1, wherein each beam support bracket is affixed to the respective steel pier by means of U-bolts.

11. The support structure of claim 10, further comprising a shear stud extending from each beam support bracket through a hole in the respective steel pier.

12. A method of supporting a building, comprising: embedding into or otherwise supporting upon a ground surface a pair of steel piers so as to extend upwardly therefrom, vertically, adjustably affixing to each said pier a respective beam support bracket, securing a wall support beam to each bracket so as to extend substantially horizontally therebetween, and securing a floor support member to each pier so as to support a floor.

* * * * *